United States Patent [19]

Nichols et al.

[11] Patent Number: 4,526,183

[45] Date of Patent: Jul. 2, 1985

[54] FILTER CIGARETTE

[75] Inventors: Walter A. Nichols; Reginald W. Newsome; Willard A. Geiszler, Jr., all of Richmond, Va.

[73] Assignee: Philip Morris Incorporated, New York, N.Y.

[21] Appl. No.: 582,598

[22] Filed: Feb. 22, 1984

Related U.S. Application Data

[63] Continuation-in-part of Ser. No. 429,393, Sep. 30, 1982, abandoned.

[51] Int. Cl.[3] ..... A24D 3/04

[52] U.S. Cl. ..... 131/336; 131/338

[58] Field of Search ..... 131/336, 338–340, 131/198 A, 198 R

[56] References Cited

U.S. PATENT DOCUMENTS

| | | | |
|---|---|---|---|
| 1,015,723 | 1/1912 | Blackwood | 131/198 A |
| 2,269,995 | 1/1942 | Trane | 131/336 |
| 2,693,193 | 11/1954 | Pelletier | 131/182 |
| 2,841,153 | 7/1958 | Pelletier | 131/336 |
| 2,923,647 | 2/1960 | Aghnides | 131/336 |
| 2,936,763 | 5/1960 | Saffir | 131/336 |
| 3,057,360 | 10/1962 | Bugge | 131/336 |
| 3,116,741 | 1/1964 | Speck | 131/187 |
| 3,232,299 | 2/1966 | Miller | 131/198 A |
| 3,283,762 | 11/1966 | Kissel | 131/336 |
| 3,359,988 | 12/1967 | Thomson | 131/336 |
| 3,376,874 | 5/1965 | Kim et al. | 131/338 |
| 3,441,028 | 4/1969 | Wall | 131/338 |
| 3,463,166 | 8/1969 | Bennett et al. | 131/178 |
| 3,503,406 | 3/1970 | Riegel et al. | 131/336 |
| 3,512,537 | 5/1970 | Pelletier | 131/336 |
| 3,519,000 | 7/1970 | Houser | 131/198 A |
| 3,590,825 | 7/1971 | Davis | 131/336 |
| 3,601,131 | 8/1971 | Reggio | 131/198 A |
| 3,608,561 | 9/1971 | Dock | 131/10 A |
| 3,664,350 | 5/1972 | Wall | 131/336 |
| 3,685,522 | 8/1972 | Kleinhans | 131/198 A |
| 3,695,274 | 10/1972 | Summers | 131/336 |
| 3,707,975 | 1/1973 | Davis | 131/336 |
| 3,713,452 | 1/1973 | D'Elia et al. | 131/198 A |
| 3,759,268 | 9/1973 | Plourde | 131/336 |
| 3,773,053 | 11/1973 | Stephens, Jr. | 131/336 |
| 3,774,662 | 11/1973 | Steigerwald | 131/336 |
| 3,789,855 | 2/1974 | Norman | 131/9 |
| 3,916,914 | 11/1975 | Brooks et al. | 131/336 |
| 4,254,782 | 3/1981 | Ligeti | 131/187 |
| 4,340,074 | 7/1982 | Tudor | 131/362 |
| 4,343,319 | 8/1982 | Cantrell | 131/336 |
| 4,362,171 | 12/1982 | Johnson et al. | 131/336 |
| 4,380,241 | 4/1983 | Horsewell | 131/336 |
| 4,433,696 | 2/1984 | Adams | 131/336 |

*Primary Examiner*—V. Millin
*Assistant Examiner*—H. Macey
*Attorney, Agent, or Firm*—Jeffrey H. Ingerman

[57] ABSTRACT

A variable dilution filter cigarette is provided which includes a substantially cylindrical tobacco rod, an axially aligned, substantially cylindrical filter plug wrapped in a substantially air-permeable plug wrap, and a substantially air-permeable first layer of tipping paper which joins the filter plug to the tobacco rod. Circumscribing the first layer of tipping paper is a second layer of substantially air-impermeable tipping paper. The second layer has a circumferentially extending row of closely spaced perforations intermediate its two ends which divides it into a mouth-end sleeve attached to the first layer at the mouth end of the cigarette and a second rod-end sleeve detachable from the mouth-end sleeve.

7 Claims, 4 Drawing Figures

FIG. 1
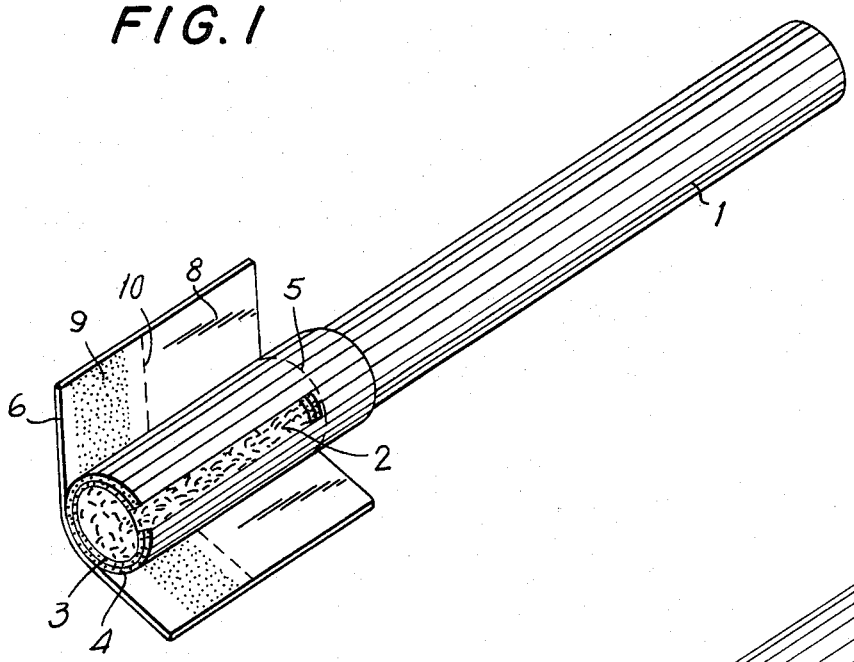
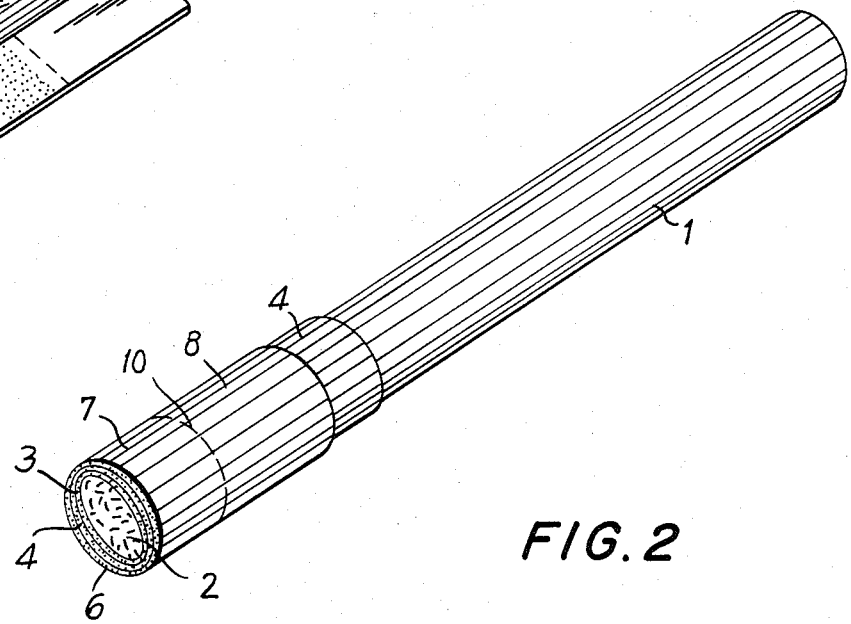
FIG. 2

FIG. 3
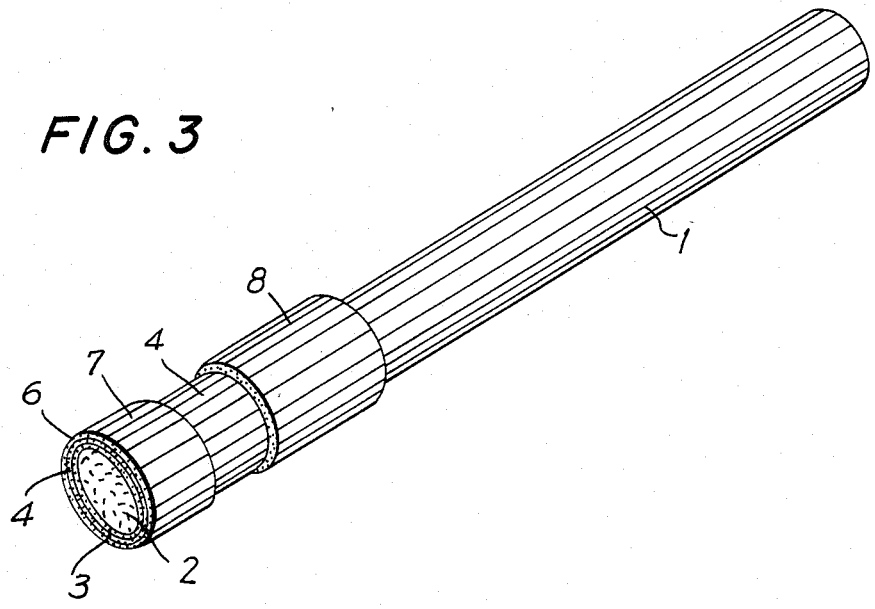
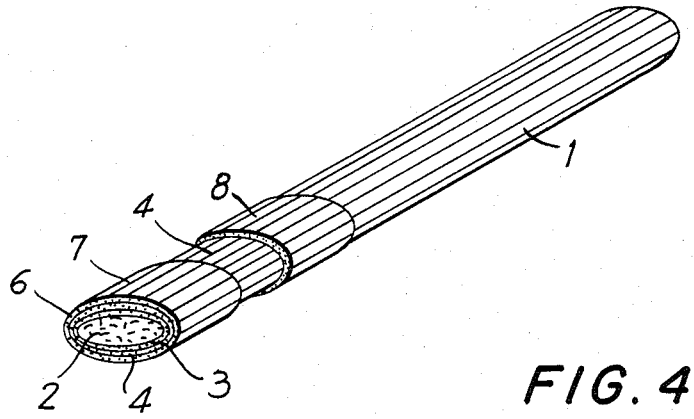
FIG. 4

FILTER CIGARETTE

CROSS-REFERENCE TO RELATED APPLICATION

This application is a continuation-in-part of copending U.S. patent application Ser. No. 429,393, filed Sept. 30, 1982, now abandoned.

FIELD OF THE INVENTION

The present invention relates to filter cigarettes. More particularly, the present invention relates to filter cigarettes which are adjustable by the smoker to vary the air dilution value of the cigarette.

BACKGROUND OF THE INVENTION

Various mechanisms have been disclosed in heretofore issued patents which provide for adjustment of the air dilution value of filter cigarettes, but these mechanisms are not without certain disadvantages. While many complicated mechanisms have been disclosed, the simpler mechanisms generally involve making one or more openings through a substantially air-impermeable filter plug wrap and the overlying substantially air-impermeable tipping paper and one or more corresponding openings in a sleeve which is placed over the tipping paper and which is then either rotated or moved axially to select the degree to which the two sets of openings are in registry.

Among the problems associated with such a mechanism are that the sleeve may be inadvertently removed from the mouth end of the cigarette by the smoker and not readily replaced, and that when dilution is desired, the registry between the two sets of openings may be inadvertently destroyed by a slight axial movement of the sleeve. Accordingly, th dilution, once set by the smoker, is not insured of any degree of consistency. Yet another problem associated with a number of prior devices is that they have not been readily adaptable to a high rate of production on conventional cigarette making machinery.

Accordingly, it is an object of the present invention to provide an improvement on such variable dilution filter cigarettes which can be readily manufactured on conventional cigarette making equipment.

SUMMARY OF THE INVENTION

A filter cigarette is provided which comprises a substantially cylindrical tobacco rod, that is, a charge of tobacco wrapped in cigarette paper, an integral, axially aligned, substantially cylindrical, wrapped filter plug and two circumscribing layers of tipping paper. The tobacco rod and wrapped filter plug have substantially the same cross-sectional area and shape, which may be a circular or an ovoid shape. The filter plug has a mouth end and a rod end, each of which is open to permit the passage of air and smoke, and is wrapped in a substantially air-permeable plug wrap. The tobacco rod and filter plug are axially aligned in abutting, end-to-end relation and are joined by a first circumscribing layer of air-permeable tipping paper which extends from the mouth end of the filter plug to a position on the tobacco rod adjacent the rod end of the filter plug. The second layer of tipping paper, which is air impermeable, circumscribes the first layer of tipping paper and extends substantially from the mouth end of the filter plug to the rod end of the first layer of tipping paper. The second layer has a circumferentially extending row of closely spaced perforations intermediate its two ends. The mouth-end portion of the second layer is attached to the underlying first layer of tipping paper. The rod-end portion of the second layer is rotated about the axis of the cigarette to break the perforations, thus forming a sleeve which may be moved axially between the mouth-end portion of the second layer and positions along the tobacco rod. The mouth-end portion of the second layer prevents the sleeve from being removed from the mouth end of the cigarette.

BRIEF DESCRIPTION OF THE DRAWINGS

FIG. 1 is an enlarged, partially fragmentary, perspective view, taken from the mouth end, of a filter cigarette of the present invention.

FIG. 2 is an enlarged perspective view, taken from the mouth end, of the assembled cigarette shown in FIG. 1.

FIG. 3 is a perspective view, taken from the mouth end, of a filter cigarette of the present invention showing the axially movable band detached from the mouth-end band.

FIG. 4 is a perspective view, taken from the mouth end, of an oval cigarette of the present invention showing the axially movable band detached from the mouth-end band.

DESCRIPTION OF THE PREFERRED EMBODIMENT

The invention will now be described with reference to the figures in which like elements are given like reference numbers throughout.

One preferred embodiment of the present invention, as shown in FIGS. 1, 2 and 3, comprises a substantially cylindrical tobacco rod 1 which is axially aligned with and joined in abutting, end-to-end relation to a conventional, substantially cylindrical filter plug 2, which may be a cellulose acetate filter or the like. The filter plug is wrapped in an air-permeable plug wrap 3. The tobacco rod 1 and the wrapped filter plug have substantially the same cross-sectional area and shape. In the embodiment shown in FIGS. 1, 2 and 3, the cigarette has a conventional, circular cross-section. The wrapped filter plug is joined to the tobacco rod 1 by a circumscribing first layer of tipping paper 4 which extends from the mouth end of the filter plug to a position on the tobacco rod adjacent the rod end of the filter plug. Tipping paper 4 is air permeable and is attached, preferably by a circumferentially extending band of adhesive on its inner surface, to the outer surfaces of the tobacco rod and the filter plug wrap. The band of adhesive is centered on either side of the line of abutment 5.

A second layer of tipping paper 6 circumscribes the first layer of tipping paper and extends substantially from the mouth end to the rod end of the filter plug. This second layer is divided into a mouth-end sleeve 7 and a rod-end sleeve 8 by a circumferentially extending row of closely spaced perforations 10. The mouth-end sleeve 7 is attached to tipping paper 4 adjacent the mouth end of the filter plug, preferably by a band of adhesive 9 on its inner surface. The rod-end sleeve 8 is not attached to the underlying layer of tipping paper 4. The second layer of tipping paper 6 is substantially air impermeable and the rod-end sleeve 8 is detachable along the line of perforations 10. In its attached form, the cigarette has a set air dilution value which, if the smoker prefers, can be varied by rotating the rod-end sleeve 8 to detach it from the mouth-end sleeve 7 and then axially moving sleeve 8 towards the coal end of the tobacco rod, thereby exposing the underlying air-permeable tipping paper 4. This axial movement permits varying degrees of air to enter the filter, thereby diluting the smoke and changing the air dilution value of the cigarette. Sleeve 8 is retained against removal from the mouth end of the cigarette by the attached mouth-end sleeve 7.

In an alternative embodiment, the plug wrap and the first layer of tipping paper may also be substantially air impermeable and may contain a plurality of openings which are exposed when sleeve 8 is detached and moved axially towards the coal end of the cigarette.

The filter cigarette of the present invention may be readily produced on conventional cigarette making equipment with a minimum of modifications. Forming and cutting the cigarette rod and the filter plug to length are done conventionally. Also, bringing the filter plug into axially alignment with the cigarette rod and overwrapping with the first layer of tipping paper are accomplished in the same manner as in conventional cigarettes except that the adhesive applicator is adapted to provide a band of adhesive only on the portion of the first layer of tipping paper which overlaps and joins the plug wrap to the tobacco rod. The same machine for applying the first layer of tipping paper may also be employed to apply the second layer of tipping paper, with the glue applicator adapted to provide a band of glue only at a position corresponding to the mouth-end sleeve portion of the second layer of tipping paper.

The row of perforations in the second layer of tipping paper may be made, preferably prior to application, by any conventional means such as laser perforation, electrostatic perforation, or mechanical perforation using points or knives. It is preferred to employ a laser perforation device in order to make the perforations extremely small and, in practice, the tipping paper is fed through a perforating zone where it is exposed to a laser light beam focused laterally of the width of the traveling tipping paper so as to define the desired width of the detachable sleeve portion of the second layer of tipping paper. The power settings and focusing of the laser beam and the rate of feed of the tipping paper are selected so as to all but part the paper along the "break away" line 10 shown in FIGS. 1 and 2. Preferably, the laser system is employed to make about 100 perforations per inch in the paper along the line 10. The attachment which remains is selected to retain enough strength to hold the sleeves together during assembly but permits the detachable sleeve to be readily detached by the smoker without tearing the tipping paper other than between the perforations.

Another preferred embodiment of the present invention is shown in FIG. 4 and differs from the embodiment shown in FIGS. 1, 2, 3 and 4 in having an ovoid cross-section. The cross-sectional area and shape of the tobacco rod and the wrapped filter plug are substantially the same and the tobacco rod and wrapped filter plug are joined in abutting, end-to-end relation such that the cross-sections are in registry.

It will be understood that the particular embodiments described above are only illustrative of the principles of the present invention, and that various modifications can be made by those skilled in the art without departing from the scope and spirit of the present invention.

We claim:

1. A filter cigarette, comprising a substantially cylindrical tobacco rod, a substantially cylindrical filter plug, a substantially air-permeable plug wrap circumscribing the filter plug, a first layer of tipping paper, and a second layer of tipping paper, wherein the tobacco rod and the wrapped filter plug have substantially the same cross-sectional area and shape, the filter plug has a mouth end and a rod end open to permit the passage of air and smoke, the tobacco rod and the wrapped filter plug are axially aligned in abutting, end-to-end relation and circumscribed and joined by the first layer, the first layer extends from the mouth end of the filter plug to a position on the tobacco rod adjacent the rod end of the filter, the first layer is air permeable, the second layer is substantially air impermeable and circumscribes the first layer, the second layer extends substantially from the mouth end to the rod end of the first layer, and the second layer has means for dividing it into a first, mouth-end sleeve attached to the first layer, and a second, rod-end sleeve detachable from the first sleeve for axial movement between the first sleeve and positions along the tobacco rod to expose the underlying air-permeable first layer, thereby varying the amount of air admitted to the filter.

2. A filter cigarette, comprising a substantially cylindrical tobacco rod, a substantially cylindrical filter plug, a plug wrap circumscribing the filter plug, a first layer of tipping paper, and a second layer of tipping paper, wherein the tobacco rod and the wrapped filter plug have substantially the same cross-sectional area and shape, the filter plug has a mouth end and a rod end open to permit the passage of air and smoke, the tobacco rod and the wrapped filter plug are axially aligned in abutting, end-to-end relation and are circumscribed and joined by the first layer, the first layer extends from the mouth end of the filter plug to a position on the tobacco rod adjacent the rod end of the filter plug, the first layer and the plug wrap are substantially air impermeable and have a plurality of communicating openings therethrough, the second layer is substantially air impermeable and circumscribes the first layer, the second layer extends substantially from the mouth end to the rod end of the first layer, and the second layer has means for dividing it into a first, mouth-end sleeve attached to the first layer, and a second, rod-end sleeve detachable from the first sleeve for axial movement between the first sleeve and positions along the tobacco rod to expose the openings in the underlying first layer, thereby varying the amount of air admitted to the filter.

3. The filter cigarette of claim 1 or 2 wherein the tobacco rod and the wrapped filter plug have a circular cross-section.

4. The filter cigarette of claim 1 or 2 wherein the tobacco rod and the wrapped filter plug have an ovoid cross-section and are joined to each other such that the cross-sections are in registry.

5. A filter cigarette, comprising a substantially cylindrical tobacco rod, a substantially cylindrical filter plug, a substantially air-permeable plug wrap circumscribing the filter plug, a first layer of tipping paper, and a second layer of tipping paper, wherein the tobacco rod and the wrapped filter plug have substantially the same cross-sectional area and have ovoid cross sections in registry, the filter plug has a mouth end and a rod end open to permit the passage of air and smoke, the tobacco rod and the wrapped filter plug are axially aligned in abutting, end-to-end relation and circumscribed and joined by the first layer, the first layer extends from the mouth end of the filter plug to a position on the tobacco rod adjacent the rod end of the filter, the first layer is air permeable, the second layer is substantially air impermeable and circumscribes the first layer, the second layer extends substantially from the mouth end to the rod end of the first layer, and the second layer has means for dividing it into a first, mouth-end sleeve attached to the first layer, and a second, rod-end sleeve detachable from the first sleeve for axial movement between the first sleeve and positions along the tobacco rod to expose the underlying air-permeable first layer, thereby varying the amount of air admitted to the filter.

6. A filter cigarette, comprising a substantially cylindrical tobacco rod, a substantially cylindrical filter plug, a plug wrap circumscribing the filter plug, a first layer of tipping paper, and a second layer of tipping paper, wherein the tobacco rod and the wrapped filter plug have substantially the same cross-sectional area and have ovoid cross sections in registry, the filter plug has a mouth end and a rod end open to permit the passage of air and smoke, the tobacco rod and the wrapped filter plug are axially aligned in abutting, end-to-end relation and are circumscribed and joined by the first layer, the first layer extends from the mouth end of the filter plug to a position on the tobacco rod adjacent the rod end of the filter plug, the first layer and the plug wrap are substantially air impermeable and have a plurality of communicating openings therethrough, the second layer is substantially air impermeable and circumscribes the first layer, the second layer extends substantially from the mouth end to the rod end of the first layer, and the second layer has means for dividing it into a first, mouth-end sleeve attached to the first layer, and a second, rod-end sleeve detachable from the first sleeve for axial movement between the first sleeve and positions along the tobacco rod to expose the openings in the underlying first layer, thereby varying the amount of air admitted to the filter.

7. The filter cigarette of claim 1, 2, 5 or 6 wherein the second layer extends from the mouth end of the filter plug to the rod end of the filter plug.

* * * * *